US005092564A

United States Patent [19]

Basen et al.

[11] Patent Number: 5,092,564

[45] Date of Patent: Mar. 3, 1992

[54] COLUMN FOR TREATING PARTICULATE MATERIALS WITH A GAS

[75] Inventors: Toralv Basen, Sandvika; Robin Ephithite, Fredrikstad, both of Norway

[73] Assignee: Elkem Technology a/s, Norway

[21] Appl. No.: 556,265

[22] Filed: Jul. 20, 1990

Related U.S. Application Data

[62] Division of Ser. No. 339,687, Apr. 18, 1989, Pat. No. 4,975,116.

[30] Foreign Application Priority Data

Apr. 20, 1988 [NO] Norway ..... 881690

[51] Int. Cl.[5] ..... C21B 1/10

[52] U.S. Cl. ..... 266/172; 432/58

[58] Field of Search ..... 266/217, 172; 432/58; 75/414

[56] References Cited

U.S. PATENT DOCUMENTS

| | | | |
|---|---|---|---|
| 2,384,971 | 9/1945 | Silvasy et al. | 266/172 |
| 3,348,941 | 10/1967 | King | 75/26 |
| 3,923,498 | 12/1975 | Volk | 75/26 |
| 4,042,376 | 8/1977 | Collin | 75/26 |
| 4,060,375 | 11/1977 | Weber et al. | 432/58 |
| 4,321,032 | 3/1982 | Brice et al. | 432/58 |
| 4,527,973 | 7/1985 | Kondoh et al. | 432/58 |
| 4,975,116 | 12/1990 | Båsen et al. | 75/414 |

*Primary Examiner*—S. Kastler, III
*Attorney, Agent, or Firm*—Lucas & Just

[57] ABSTRACT

The present invention relates to a method for production of metals and/or ferro alloys by prereduction of particulate metal oxide co-current with a reducing gas. Reducing gas having a temperature between 650° and 1100° C. and metal oxide particles are supplied at the lower end of a substantially vertical prereduction column which comprises at least two chambers having a substantially circular cross-section, said chambers in their upper and lower ends having a decreasing cross-section and where a ringshaped member for decreasing the cross-section is arranged in the intermediate zone between the chambers. The mixture of reducing gas and prereduced metal oxide particles is collected at the top of the prereduction column, whereafter the prereduced metal oxide particles are transported to a smelting furnace for smelting and final reduction to metallix state by addition of a reduction material.

The present invention also relates to a column for treatment of particulate solid materials with a gas. The column comprises at least two chambers having a substantially circular cross-section. The chambers have in their upper and lower ends a dreasing cross-section, and a ringshaped member is arranged at least in the intermediate zone between each chamber for decreasing the cross-section in the intermediate zone.

7 Claims, 3 Drawing Sheets

COLUMN FOR TREATING PARTICULATE MATERIALS WITH A GAS

This is a division of application Ser. No. 339,687, filed Apr. 18, 1989, now U.S. Pat. No. 4,975,116 issued Dec. 4, 1990.

The present invention relates to a method for production of metals and ferroalloys by direct reduction. The raw materials which are used by the method comprise particulate oxide containing materials and particulate solid reduction materials. The method is particularly suited for production of steel from iron oxide containing materials, but can also be used in connection with production of ferro-nickel from iron-nickel oxide ore, for production of ferro manganese from manganese oxide containing materials and for reduction of chromium oxide.

The present invention also relates to a column for treating solid materials with a gas which column for example can be used for prereduction of metal oxides with a reducing gas.

By particulate oxide containing materials it is to be understood materials having a particle size of less than 3 mm, preferably less than 1 mm, and a mean particle size of less than 0.5 mm.

By particulate reduction materials it is to be understood carbon containing materials, such as lignite, mineral coal, anthrasite etc. having a particulate size below 5 mm, preferably below 3 mm.

The method according to the present invention includes prereduction of metal oxides and direct smelting and final reduction of the prereduced oxides in a smelting furnace, wherein the prereduction is carried out by means of a reduction gas which flows co-currently with the oxide particles.

The method of the present invention is particularly suited for production of steel and ferromanganese from particulate oxide materials.

It is known that when reduction gas and metal oxide particles are transported co-currently the theoretical best utility of the reduction gas is obtained. In order to obtain a sufficient degree of reduction it is, however, for most metal oxides such as iron oxide, manganese oxide, chromium oxide and nickel oxide necessary to use such long reduction columns that reduction of the oxides by transport of particulate oxide co-currently with a reducing gas is not economically viable due to very high investment costs.

It is an object of the present invention to provide a method which makes it possible to carry out prereduction of particulate metal oxide in co-current flow with a reducing gas in an economically viable way.

It is further an object of the present invention to produce a reducing gas from a solid particulate carbon containing material in an economically viable way and to utilize the solid particulate carbon-containing material also in the final reduction of the prereduced particulate metal oxides.

Finally, it is an object of the present invention to provide a column for treatment of solid materials co-current with a gas.

Thus according to a first embodiment the present invention relates to a method for production of metals and ferroalloys by prereduction of particulate metal oxide co-current with a reduced gas whereafter the prereduced oxide is melted and subjected to final reduction, and the method is characterized in that a reducing gas with a temperature between 650° C. and 1100° C. and particulate metal oxide are introduced at the lower end of at least one substantially vertical reduction column which column comprises at least two chamber having a substantially circular cross-section, said chambers in their upper and lower ends have a decreasing cross-section and that in the intermediate zone between each chamber is arranged a ring shaped member which reduces the cross-section in the intermediate zone between the chambers, that metal oxide particles and reduction gas pass through the reduction column in co-current flow, that the mixture of reduction gas and prereduced metal oxide particles is collected at the top of the reduction column, whereafter the metal oxide particles are transported to a smelting furnace wherein the metal oxide particles are melted and reduced to metallic state by addition of a reduction material.

According to a preferred embodiment of the method of the prereduction is carried out in two reduction columns, where fresh reduction gas and partly prereduced metal oxide particles are introduced in the lower end of the first reduction column whereby the partly reduced metal oxide particles and the reduction gas are transported in co-current flow through the first reduction column, that reduction gas and metal oxide particles reduced to a preset reduction grade are collected at the top of the first reduction column whereafter the metal oxide particles with preset reduction grade are transported to the smelting furnace where the prereduced metal oxide particles are melted and reduced to metallic state, while the reduction gas collected from the top of the first reduction column together with unreduced metal oxide particles are introduced in the bottom of the second reduction column, the metal oxide particles and reduction gas are transported in co-current flow through the second reduction column, the mixture of reduction gas and partly prereduced metal oxide particles is collected at the top of the second reduction column and the partly prereduced metal oxide particles are introduced in the bottom of the first reduction column.

According to a preferred embodiment of the method the reducing gas is produced by introducing particulate carbon containing material and an oxygen containing gas to a chamber which is connected to the lower part of the reduction column, respectively the first reduction column, whereby the particulate carbon containing material is coked and a reduction gas containing essentially CO and $H_2$ is produced, whereafter the coked reduction material particles and the reduction gas flow into the bottom of the reduction column, the coked reduction material particles and the prereduced metal oxide particles are separated from the reduction gas at the top of the reduction column and, the coked reduction material particles and the prereduced metal oxide particles are transported to the smelting furnace, where the coked reduction material particles constitute at least a part of the necessary amount of reduction material for final reduction of the prereduced metal oxide particles.

The present invention further relates to a column for treatment of particulate solid materials in co-current flow with a gas, preferably a column for prereduction of particulate metal oxides with a reducing gas, which column is characterized in that it comprises at least two chambers where each of the chambers have an essentially circular cross-section and where the chambers in the upper and lower ends have a decreasing cross-section and where a ring-shaped member is arranged at least in the intermediate zone between the chambers in order to reduce the cross-section in the intermediate zone between the chambers.

According to a second embodiment of the column according to the present invention, a pipe having a circular cross-section is arranged in the intermediate zone between each of the chambers, the diameter of the pipe being less than the diameter of the chambers.

By the method of the present invention a strongly reduced amount of gas for transport of the oxide particles is obtained compared to the amount of gas which has to be used in known methods for reduction of oxide particles in co-current flow with a gas. Further, by the method of the present invention a stable flow system is obtained without risk for downward flow of oxide particles at low gas velocities.

A substantial advantage obtained by the method of the present invention compared to known systems for co-current reduction of oxide particles in a gas flow, is that the degree of reduction can be regulated in a way that was unknown until now. Thus the composition of the reduction gas will within each chamber be within certain limits, resulting in that all particles which leave a chamber will have a substantially equal degree of reduction and thus the prereduced particles which are collected at the top of the reduction column will have substantially equal degree of reduction. The reason for this will be explained later. This is a very important advantage compared to for example reduction in a fluidized bed or reduction in a co-current flow with a reducing gas in a straight column. In fluidized bed reduction the fluidizing chamber will contain particles with highly different degree of reduction, from almost unreduced particles to particles which are reduced to metallic state. Pre-reduced particles from a fluidized bed will thus be inhomogeneous with respect to degree of reduction the same will be true for a straight column.

By the method of the present invention the mixture of oxide particles, reduction gas and possibly coked reduction material particles, flow into the lower chamber of the reduction column. The gas flow is adjusted in such a way that the gas velocity is higher than the downward movement of the oxide particles. The amount of gas and of oxide particles are further adjusted in order to obtain an upward and stable flow of gas and oxide-particles. The greater part of particles will, due to the flow conditions, tend to flow outwards against the walls of the chamber and will fall down along the wall. The downward flowing oxide particles will then enter upon the ringshaped member in the lower part of the chamber and again enter into the upward flowing gas and again be transported upwards.

In the upper part of the chamber where the cross-section of the chamber starts to decrease, the gas velocity will increase and the gas velocity will be substantially higher than the downward movement of the oxide particles. Oxide particles which are in the upper part of the chamber will therefore be transported upwards to the next chamber where the process is repeated. As the mean gas velocity in all chambers are higher than the downward movement of the particles, accumulation of oxide particles will not happen, and the amount of oxide particles which enter into a chamber and the amount of oxide particles leaving a chamber will be the same.

Due to the above mentioned downward flow of oxide particles along the wall of the chamber, an increased volume density of particles will be obtained near the lower end of each chamber whereby the retention time of the oxide particles in the chamber will be much higher than the retention time for the reducing gas. The high gas velocity in the area of ringshaped member results in that oxide particles will not fall down into the chamber below. Thus the ringshaped member creates an effective separation of each chamber. This separation of the chambers in reduction column secures that prereduced particles in the upper part of the reduction column will not fall down into the lower part of the reduction column, where the gas would further reduce the oxide particles to such an extent that melting and sintering of the oxide particles would unavoidably have happened.

The retention time and the degree of increased volume density of the oxide particles in the reduction column are dependent on the number of chambers, the ratio between diamter and height of the chamber, the shape of the ringshaped member, gas volumne, particle volume and particle size.

A further advantage of the method according to the present invention is that the continuous downward flow of oxide particles on the walls in the chamber in the reduction column prevents deposits and sintering of oxide particles on the walls.

The problem with deposits and sintering which often takes place in direct reduction processes is thereby avoided in a simple and safe way by the method according to the present invention.

By the above mentioned preferred method for production of reducing gas a very high utilization of the reduction material is achieved, as the volatiles of the coal and a part of the solid carbon are converted to reducing gas in the gasifier chamber, while the rest of the reduction material, particulate coke, follows the oxides to the smelting furnace where they are used as reduction material by smelting and final reduction of the prereduced oxides in the smelting furnace.

The method according to the present invention can, however, be operated by use of a reducing gas which has been produced in any conventional way.

It is preferred to preheat the oxide particles before they are supplied to the reduction column, and preferably off-gases from the reduction column are used for the preheating.

BRIEF DESCRIPTION OF THE DRAWINGS

The method and the apparatus according to the present invention will now be further described with reference to the accompanying drawings, wherein.

FIG. 1 shows a flow sheet for an embodiment which is especially suited for production of steel from particulate iron oxide particles, but which also can be used for production of for example ferronickel, ferromanganese and ferrochromium from particulate oxide particles.

Figure 1:
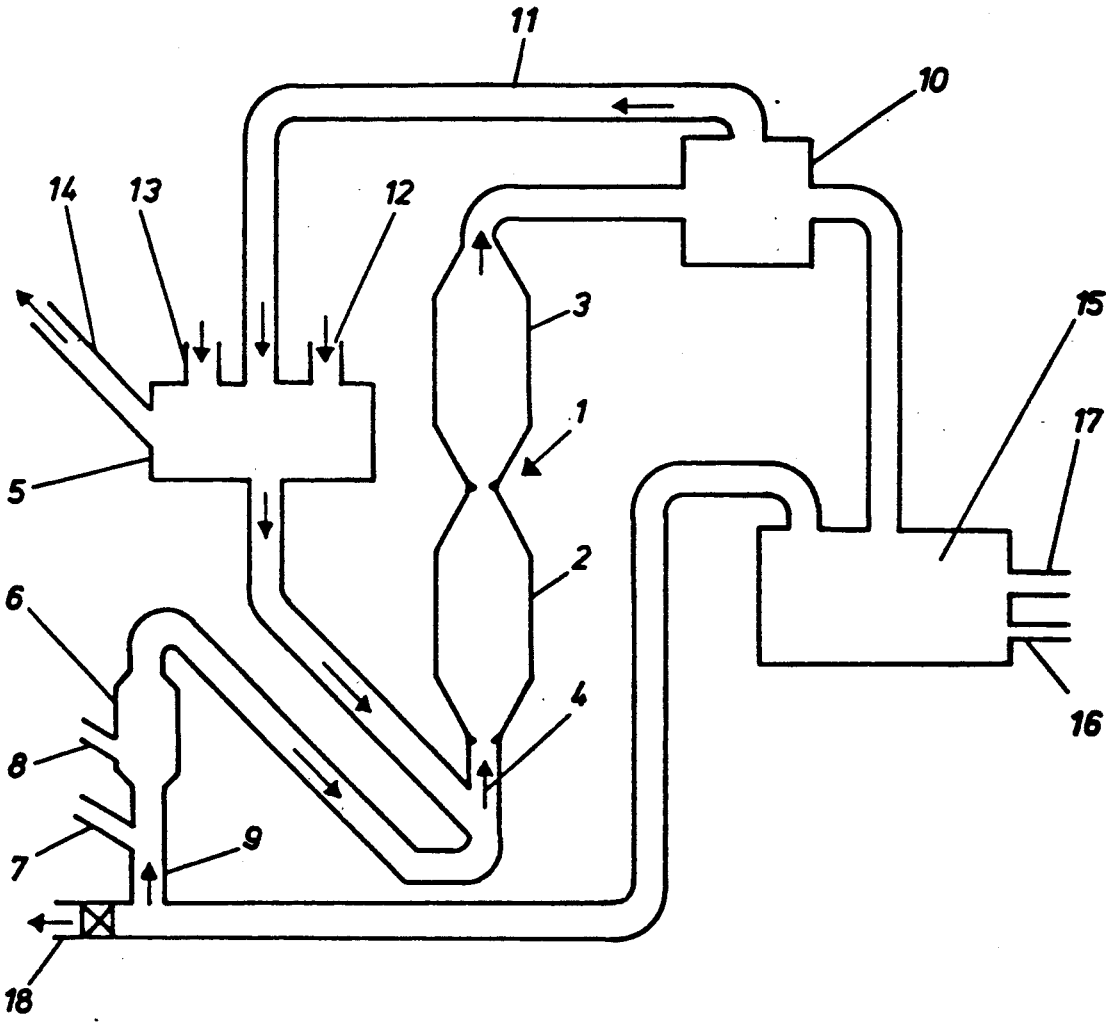
FIG. 1 shows a flow sheet for a first embodiment of the method according to the present invention.

On FIG. 1 there is shown a pre-reduction column 1 for prereduction of iron oxide particles which column comprises two chambers 2 and 3. The prereduction column 1 will be further described later in connection with FIGS. 3 and 4. To the bottom of the prereduction column a reducing gas and particulate iron oxide are supplied at 4. The iron oxide particles are preheated in a preheating step 5. The reducing gas which is supplied to the lower chamber 2 of the prereduction column 1 can be produced by any conventional method, but according to a preferred embodiment of the method according to the present invention, the reducing gas is produced in a gasifying chamber comprising a chamber 6 having means 7, 8, 9 for supply of a carbon containing material, an oxygen containing gas and recirculated offgas from the final reduction of prereduced iron oxide particles.

At the top of the reduction column 1 reducing gas is separated from prereduced iron oxide and coke particles in a separation step 10. The used reducing gas is preferably supplied to the preheating step 5 through a pipe 11. In the preheating step 5 the used reducing gas is combusted by means of air supplied at 12 for preheating iron oxide particles supplied at 13. The off-gases from the preheating step 5 are removed at 14.

The prereduced iron oxide particles and coke particles are transported from the separation step 10 and directly to the final reduction step 15. A buffer silo for prereduced iron oxide particles can be inserted between steps 10 and 15.

In the final reduction step 15 the prereduced iron oxide is reduced to iron by addition of a reduction material. The final reduction step 15 is preferably carried out in an electric smelting furnace. From the smelting furnace iron and slag is tapped at 16 and 17 respectively. A part of the off-gases from the final reduction step 15 are preferably used for production of reducing gas in step 6. The rest of the off-gases from the final reduction step 15 are bled off at 18 and can for example be used for heating purposes or for production of electric power.

On FIG. 2 there is shown a second embodiment of the method according to the present invention which differs from the embodiment described in connection with FIG. 1 in that two prereduction columns are used. The method of FIG. 2 is especially suited for reduction of iron oxide particles where a high degree of reduction is aimed in the prereduction step.

Figure 2:
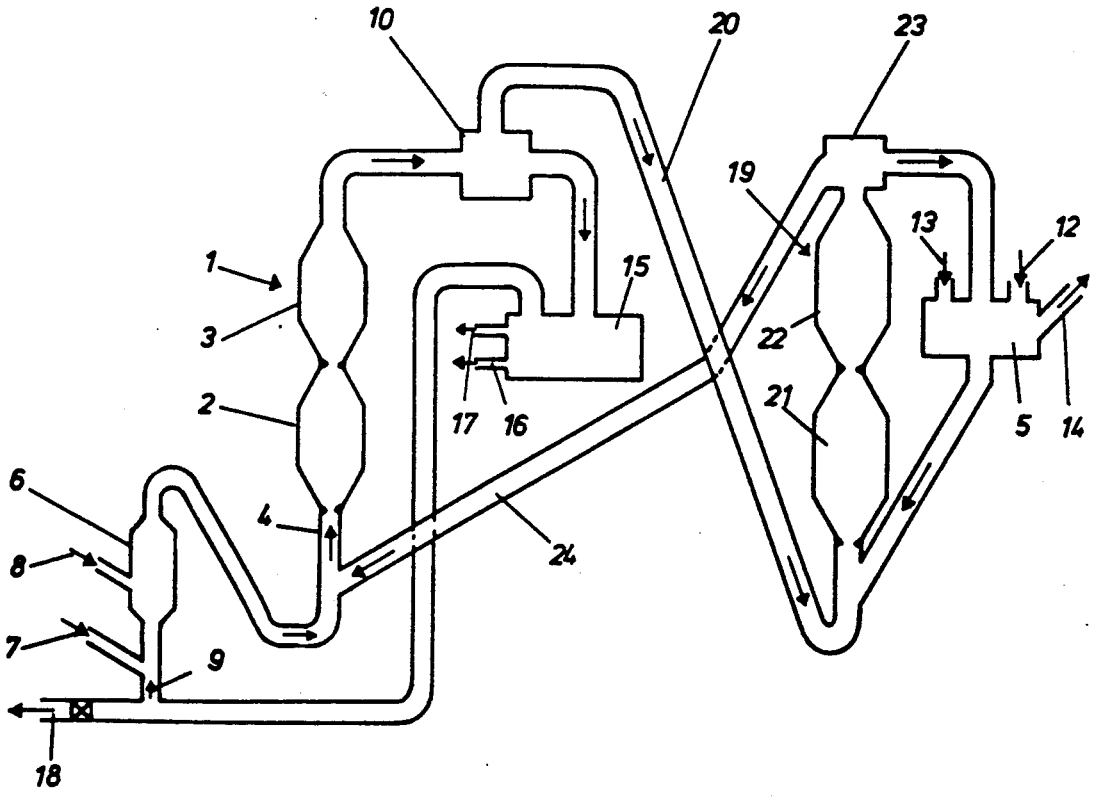
FIG. 2 shows a flow sheet for a second embodiment of the method according to the present invention.

For the parts of FIG. 2 which correspond to parts of FIG. 1 corresponding reference numerals are used.

In the method shown in the flow sheet of FIG. 2, reducing gas and coke particles which is produced in the gasification chamber 6 are supplied to the lower part of the reduction column 1 together with partly prereduced iron oxide particles from a second prereduction column 19. After co-current prereduction in the prereduction column 1 the reducing gas is separated from the prereduced iron oxide particles and coke particles in step 10. This reducing gas is now transported from the separating step 10 via a pipe 20 into the bottom of the second prereduction column 19 which comprises two chambers 21, 22 having the same design as the chambers of the first prereduction column 1. Preheated iron oxide particles are supplied to the lower part of the second prereduction column 19. From the top of the second prereduction column 19 partly prereduced iron oxide particles and used reduction gas are collected. The partly prereduced iron oxide particles are separated from the used reduction gas in a step 23 and are transported via a pipe 24 into the lower part of the first prereduction column 1, while the used reducing gas is transported to the preheating step 5.

The prereduced iron oxide particles and coke particles which are separated from the gas in step 10 are transported to the final reduction step 15 where the prereduced iron oxide particles are melted and subjected to final reduction in the way described above in connection with FIG. 1.

In the embodiment of the method shown in FIG. 2 a very high utilization of the reducing gas is obtained at the same time as the degree of reduction of the iron oxide particles can be regulated very accurately in the prereduction columns 1 and 19.

Figure 3:
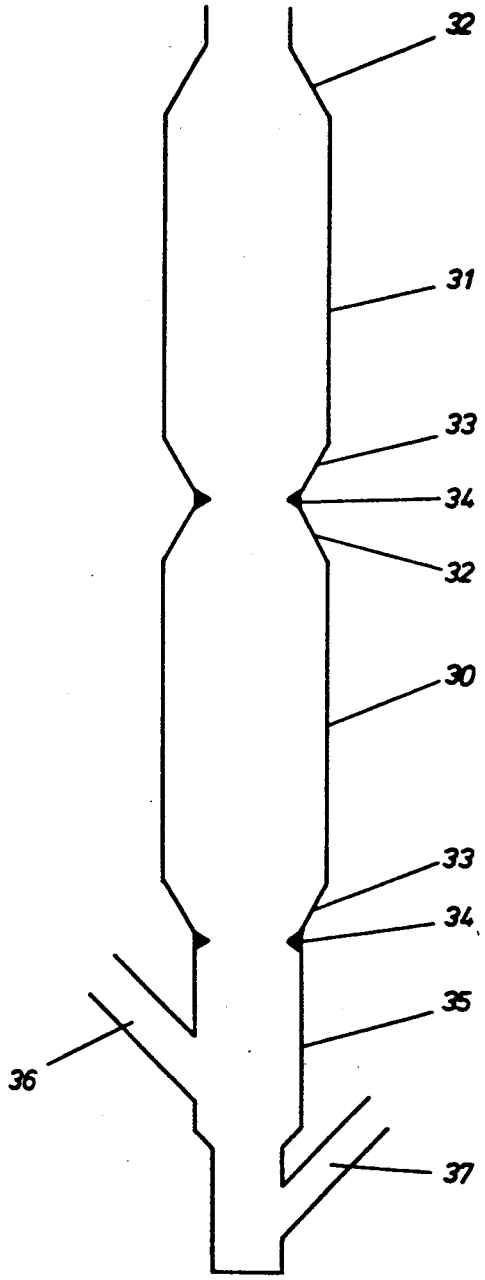
FIG. 3 shows a first embodiment of a column according to the present invention having two chambers.

On FIG. 3 there is shown a first embodiment of a column according to the present invention. The column can be used generally for treatment of particulate solid materials in co-current flow with a gas and the column is specially suited for prereduction of particulate metal oxides with a reducing gas.

The column shown in FIG. 3 comprises two chambers 30 and 31. The chambers 30 and 31 have a generally circular cross-section. The chambers have in their upper and lower ends a decreasing diameter where the upper part 32 and the lower part 33 of the chambers have an angle with the horizontal of between 50° and 70°, preferably about 60°. The upper end of the chamber 31 can, however, have an angle with the horizontal of down to 0° C. In the intermediate zone between the chambers 30 and 31 and in the bottom of the lower chamber 30 there are arranged ringshaped members 34 having an inward and downward declining upper surface. As illustrated in the drawings, the ring shaped members 34 are of substantially triangular cross-section. The importance of the ringshaped members 34 will be described below.

Below the lower chamber 30 there is arranged a pipe 35 having inlet openings 36 and 37 for particulate materials and gas, respectively.

In operation of the column according to the present invention a treatment gas with a wanted temperature is supplied to the inlet opening 37 and flows up through the pipe 35. Particulate material, for example iron oxide ore, are continuously supplied to the pipe 35 through the inlet opening 36. The particulate material can also be supplied directly into the lower part of the lower chamber 30 of the column. The amount of gas which are supplied is regulated in such a way that the gas velocity in the chamber 30 and 31 is higher than the downward free fall velocity of the particles. When the particles enter into the chamber 30, respectively 31, the greater part of the particles will, due to the flowing characteristic tend to move out to the walls of the chambers 30 and 31 and will when they reach the wall, fall down along the walls of the chambers 30 and 31. The reason for this is that the gas velocity very close to the wall will be near zero. The downward flowing particles will, when they enter the ringshaped member 34 again come into contact with the upwardly moving gas flow and they will thereby again be transported upwards. In the upper part of the chambers where the cross-section starts to decrease, the gas velocity will increase and will be substantially higher than the free fall velocity of the particles. Particles which are in these parts of the chambers will thereby be transported upwards to the next chamber or out of the top of the column.

By use of the column according to the present invention a very stable system for co-current treatment of particulate material with a gas is obtained without risk of particles moving downwards from one chamber to another.

With a certain diameter of the chambers 30 and 31 the main retention time for the particulate material in each chamber can be regulated by regulation of the amount of treatment gas supplied. For each diameter of the chambers and for a particular particle system a minimum necessary gas velocity for obtaining upward transportation of the particles can be found. This minimum gas velocity can easily be calculated by a person skilled in the art.

The optimum gas velocity for a given diameter of the chamber must be calculated based on a number of variables like particle size, specific density of the particles, gas temperature and the retention time which is wanted for the particles.

Figure 4:
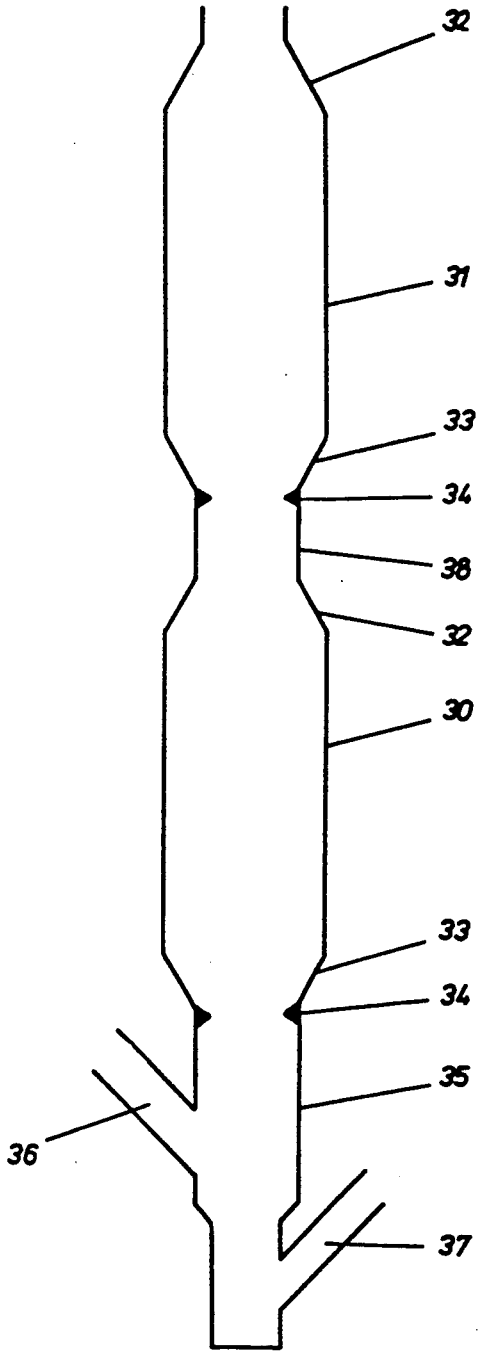
FIG. 4 shows a second embodiment of a column according to the present invention.

In FIG. 4 there is shown a second embodiment of the column according to the present invention. The column shown in FIG. 4 differs from the column of FIG. 3 only in that the chambers 30 and 31 are separated by a cylindrical pipe 38 having a smaller diameter than the diameter of the chambers 30 and 31.

Even if FIGS. 3 and 4 show columns comprising two chambers it is within the scope of the present invention to have a column with more than two chambers, for example three or four chambers.

What is claimed:

1. A column for pre-reduction of a metal oxide particulate wherein the metal oxide and reducing gas flow co-currently in the column, said column comprising:

a) a first elongated, vertically oriented chamber having a substantially circular cross-section and having a decreasing cross-section at both the upper end and the lower end, the lower end of said first chamber having an inlet for the metal oxide and reducing gas and the upper end of said first chamber having an outlet for the metal oxide and reducing gas;

b) a second elongated, vertically oriented chamber having a substantially circular cross-section and having a decreasing cross-section at both the upper end and the lower end, said second chamber being positioned above said first chamber, the lower end of said second chamber having an inlet for the metal oxide and reducing gas and said upper end having an outlet for said metal oxide and said reducing gas;

c) an intermediate zone positioned between said first and second chamber such that the metal oxide and reducing gas from the outlet of said first chamber passes through said intermediate zone and into the inlet of said second chamber;

d) a first ring shaped member of substantially triangular cross-section and having an inward and downward declining upper surface positioned in said intermediate zone for decreasing the cross-sectional area of said intermediate zone and being of a dimension to prevent backflow of particles from the second chamber to the first chamber; and e) a second ring shaped member of substantially triangular cross-section and having an inward and downward declining upper surface positioned in said inlet for said first chamber for decreasing the cross-sectional area of said inlet and being of a dimension to prevent backflow of particles out of said first chamber.

2. The column according to claim 1 wherein below the first chamber of the column is arranged an inlet pipe for gas and particulate metal oxide, said pipe having a smaller diameter than of the first chamber.

3. The column according to claim 1 wherein a vertically oriented pipe is arranged in the intermediate zone between each of the chambers in the column said pipe having a circular cross-section, said pipe having a smaller diameter than the diameter of the chambers.

4. The column according to claim 1 wherein the walls of the upper and lower parts of the chamber have an angle with the horizontal between 50° and 70°.

5. The column according to claim 2 wherein a vertically oriented pipe is arranged in the intermediate zone between each of the chambers in the column said pipe having a circular cross-section, said pipe having a smaller diameter than the diameter of the chambers.

6. The column according to claim 2 wherein, the walls of the upper and lower parts of the chamber have an angle with the horizontal between 50° and 70°.

7. The column according to claim 3 wherein, the walls of the upper and lower parts of the chamber have an angle with the horizontal between 50° and 70°.

* * * * *